US006783725B2

(12) United States Patent
Ruppi et al.

(10) Patent No.: US 6,783,725 B2
(45) Date of Patent: Aug. 31, 2004

(54) COATED CEMENTED CARBIDE BODY AND METHOD FOR USE

(75) Inventors: Sakari Ruppi, Fagersta (SE); Anna Sandberg, Fagersta (SE); Edward Laitila, Fagersta (SE)

(73) Assignee: Seco Tools AB, Fagersta (SE)

( * ) Notice: Subject to any disclaimer, the term of this patent is extended or adjusted under 35 U.S.C. 154(b) by 0 days.

(21) Appl. No.: 10/724,748

(22) Filed: Dec. 2, 2003

(65) Prior Publication Data

US 2004/0110040 A1 Jun. 10, 2004

Related U.S. Application Data

(62) Division of application No. 10/323,905, filed on Dec. 20, 2002, now Pat. No. 6,720,095.

(60) Provisional application No. 60/342,758, filed on Dec. 28, 2001.

(51) Int. Cl.[7] ..... C04B 35/634; B32B 9/00

(52) U.S. Cl. ..... 264/650; 428/697; 428/698; 428/701; 428/702; 428/704

(58) Field of Search ..... 428/697, 698, 428/701, 702, 704; 264/650

(56) References Cited

U.S. PATENT DOCUMENTS

| | | | | |
|---|---|---|---|---|
| 5,137,774 | A | | 8/1992 | Ruppi |
| 5,162,147 | A | | 11/1992 | Ruppi |
| 5,635,247 | A | | 6/1997 | Ruppi |
| 5,654,035 | A | | 8/1997 | Ljungberg et al. |
| 5,700,569 | A | | 12/1997 | Ruppi |
| 5,786,069 | A | | 7/1998 | Ljungberg et al. |
| 5,942,318 | A | | 8/1999 | Söderberg et al. |
| 5,980,988 | A | | 11/1999 | Ljungberg |
| 6,015,614 | A | | 1/2000 | Ruppi |
| 6,200,671 | B1 | | 3/2001 | Lindskog et al. |
| 6,210,726 | B1 | | 4/2001 | Schiller et al. |
| 6,221,469 | B1 | | 4/2001 | Ruppi |
| 6,251,508 | B1 | | 6/2001 | Ruppi |
| 6,472,060 | B1 | | 10/2002 | Ruppi et al. |
| 6,572,991 | B1 | * | 6/2003 | Ruppi ..... 428/699 |
| 6,632,514 | B1 | * | 10/2003 | Sulin et al. ..... 428/216 |
| 2002/0012818 | A1 | | 1/2002 | Ruppi et al. |
| 2002/0176755 | A1 | | 11/2002 | Ruppi |
| 2003/0054159 | A1 | | 3/2003 | Ruppi et al. |

* cited by examiner

*Primary Examiner*—Cathy Lam
(74) *Attorney, Agent, or Firm*—Burns, Doane, Swecker & Mathis, L.L.P.

(57) ABSTRACT

A coated sintered cemented carbide body includes a cemented carbide body, a first layer adjacent the cemented carbide body, the first layer including Ti(C,N) and having a thickness of from about 3 to about 20 $\mu$m, an alumina layer adjacent said first layer, the alumina layer including $\alpha$-$Al_2O_3$ or $\kappa$-$Al_2O_3$ and having a thickness of from about 1 to about 15 $\mu$m, and a further layer adjacent the aluminum layer of a carbide, carbonitride or carboxynitride of one or more of Ti, Zr and Hf, the further layer having a thickness of from about 1 to 15 $\mu$m. A friction-reducing layer, including one or more of $\gamma$-$Al_2O_3$, $\kappa$-$A1_2O_3$ and nanocrystalline Ti(C,N) and having a thickness of from about 1 to about 5 $\mu$m, can be adjacent to the further layer. A method to cut steel with a sintered cemented carbide body where the alumina is $\alpha$-$Al_2O_3$ and a method to cut cast iron with a sintered cemented carbide body where the alumina is $\alpha$-$Al_2O_3$.

7 Claims, 4 Drawing Sheets

COATED CEMENTED CARBIDE BODY AND METHOD FOR USE

CROSS REFERENCE TO RELATED APPLICATIONS

This application claims priority under 35 U.S.C. § 119 to U.S. Provisional Application No. 60/342,758, entitled COATED CEMENTED CARBIDE BODY AND METHOD FOR USE, filed Dec. 28, 2001, the entire contents of which are incorporated by reference herein. In addition, this application is a divisional of U.S. patent application Ser. No. 10/323,905 filed on Dec. 20, 2002, now U.S. Pat. No. 6,720,095, the entire contents of which are incorporated by reference herein.

BACKGROUND

Field of the Invention

The present application relates generally to coatings. More specifically, the present application relates to multilayer coatings including an alumina layer.

BACKGROUND OF THE INVENTION

In the discussion of the state of the art that follows, reference is made to certain structures and/or methods. However, the following references should not be construed as an admission that these structures and/or methods constitute prior art. Applicant expressly reserves the right to demonstrate that such structures and/or methods do not qualify as prior art against the present invention.

From U.S. Pat. No. 6,221,469, it appears that the use of a $\kappa$-$Al_2O_3$ coated metal cutting insert is better than an $\alpha$-$Al_2O_3$ coated cutting insert, particularly where high-speed turning is concerned. However, it has been found that in interrupted turning and in turning with coolant, the $\alpha$-$Al_2O_3$ coated insert performs better. This appears to be so because between the $\alpha$- and $\kappa$-forms, the $\alpha$ form is more ductile.

$\kappa$-$Al_2O_3$ cannot deform plastically due to its defect structure. When the application temperature is lower, e.g., with coolant, $\kappa$-$Al_2O_3$ cannot transform to $\alpha$-$Al_2O_3$ either. On the other hand, the temperature and especially the pressure are obviously high enough to activate sufficient amount of slip systems in the $\alpha$-$Al_2O_3$ phase. Consequently, the insert containing the $\kappa$-$Al_2O_3$ is more brittle due lack of plasticity during cutting.

SUMMARY OF THE INVENTION

It is an object of this invention to avoid or alleviate the problems of the prior art.

It is further an object of this invention to provide a particularly efficacious coated cemented carbide body for the cutting of steel or cast iron.

An exemplary embodiment of a coated sintered cemented carbide body comprises a cemented carbide body, a first layer adjacent the cemented carbide body, the first layer including Ti(C,N) and having a thickness of from about 3 to about 20 $\mu$m, an alumina layer adjacent said first layer, the alumina layer including $\alpha$-$Al_2O_3$ or $\kappa$-$Al_2O_3$ and having a thickness of from about 1 to about 15 $\mu$m, and a further layer adjacent the alumina layer of a carbide, carbonitride or carboxynitride of one or more of Ti, Zr and Hf, the further layer having a thickness of from about 1 to 15 $\mu$m.

In an exemplary embodiment of a coated sintered cemented carbide body, a friction-reducing layer is adjacent to the further layer, the friction-reducing layer including one or more of $\gamma$-$Al_2O_3$, $\kappa$-$Al_2O_3$ and nanocrystalline Ti(C,N). The friction-reducing layer has a thickness of from about 1 to about 5 $\mu$m.

In one aspect, the coated sintered cemented carbide body, in which the $Al_2O_3$ is $\alpha$-$Al_2O_3$, can be used to cut cast iron.

In another aspect, the coated sintered cemented carbide body, in which the $Al_2O_3$ layer is $\alpha$-$Al_2O_3$, can be used for the cutting of steel.

BRIEF DESCRIPTION OF THE DRAWING FIGURES

The objects and advantages of the invention will become apparent from the following detailed description of preferred embodiments thereof in connection with the accompanying drawings in which like numerals designate like elements and in which:

FIG. 1(*a*) shows crater wear and FIG. 1(*b*) shows flank wear.

DETAILED DESCRIPTION OF PREFERRED EMBODIMENTS

Figure 1:
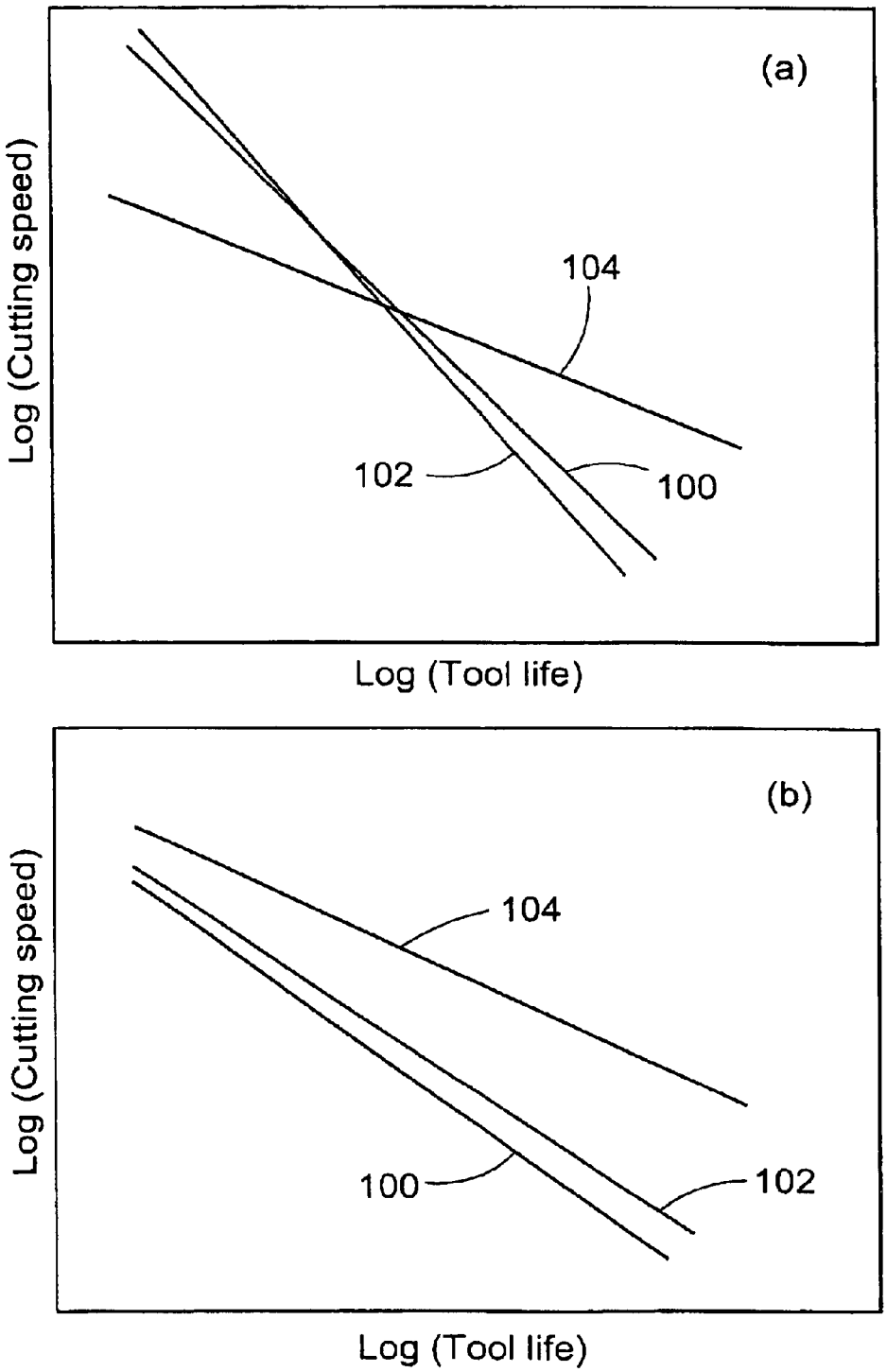
FIG. 1 shows a graph of tool life vs. cutting speed in logarithmic form for each of $\alpha$-$Al_2O_3$, $\kappa$-$Al_2O_3$, and Ti(C,N).

It has earlier been found (see, for example, U.S. Pat. No. 5,137,774) that $\alpha$-$Al_2O_3$ is a better coating on cemented carbide inserts for cutting of cast iron while a $\kappa$-$Al_2O_3$ coating on a cemented carbide insert has been considered being equal or better in applications involving the cutting of steel. FIG. 1 shows a graph of tool life vs. cutting speed in logarithmic form for each of $\alpha$-$Al_2O_3$, $\kappa$-$Al_2O_3$, and Ti(C,N). FIG. 1(*a*) shows crater wear. The results for $\alpha$-$Al_2O_3$ (labeled as 100), $\kappa$-$Al_2O_3$ (labeled as 102) and Ti(C,N) (labeled as 104) intersect at a cutting speed of approximately 350 m/minute. FIG. 1(*b*) shows flank wear. From FIG. 1(*b*), the tool life for each of $\alpha$-$Al_2O_3$ 100, $\kappa$-$Al_2O_3$ 102 and Ti(C,N) 104 increases with decreasing tool speed, with the flank wear tool life for any one cutting speed increasing between $\alpha$-$Al_2O_3$ 100 and $\kappa$-$Al_2O_3$ 102, and between $\kappa$-$Al_2O_3$ 102 and Ti(C,N) 104. From FIG. 1, it appears that the wear properties of $\alpha$-$Al_2O_3$ and $\kappa$-$Al_2O_3$ in steel are very similar. However, it has been surprisingly found that in those applications demanding toughness, much better edge strength can be obtained by substituting for the $\kappa$ layer a layer of $\alpha$ as an intermediate layer. It further appears that the differences between $\alpha$-$Al_2O_3$ and $\kappa$-$Al_2O_3$ are emphasized when the $Al_2O_3$ is applied in a multilayer structure and where a relatively thick Ti(C,N) layer overlies the $Al_2O_3$ layer.

Figure 2:
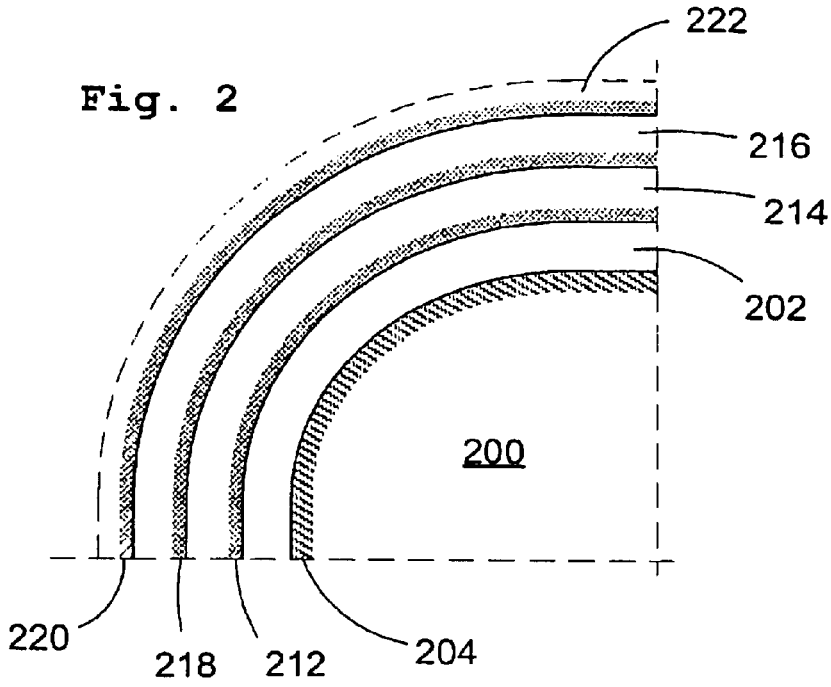
FIG. 2 is a representation of the cutting insert of the present invention.

As shown in FIG. 2, a particular aspect of the present invention, there is shown a cemented carbide body 200 upon which there is applied a layer 202 of Ti(C,N) having a thickness of from about 3 to about 20 μm, preferably from about 5 to about 15 μm. If desired, an optional TiN bonding layer 204 having a thickness of from about 0.5 to about 2 μm, preferably from about 0.5 to about 1 μm, may be applied between the cemented carbide 1 and the Ti(C,N) layer 202.

Figure 3:
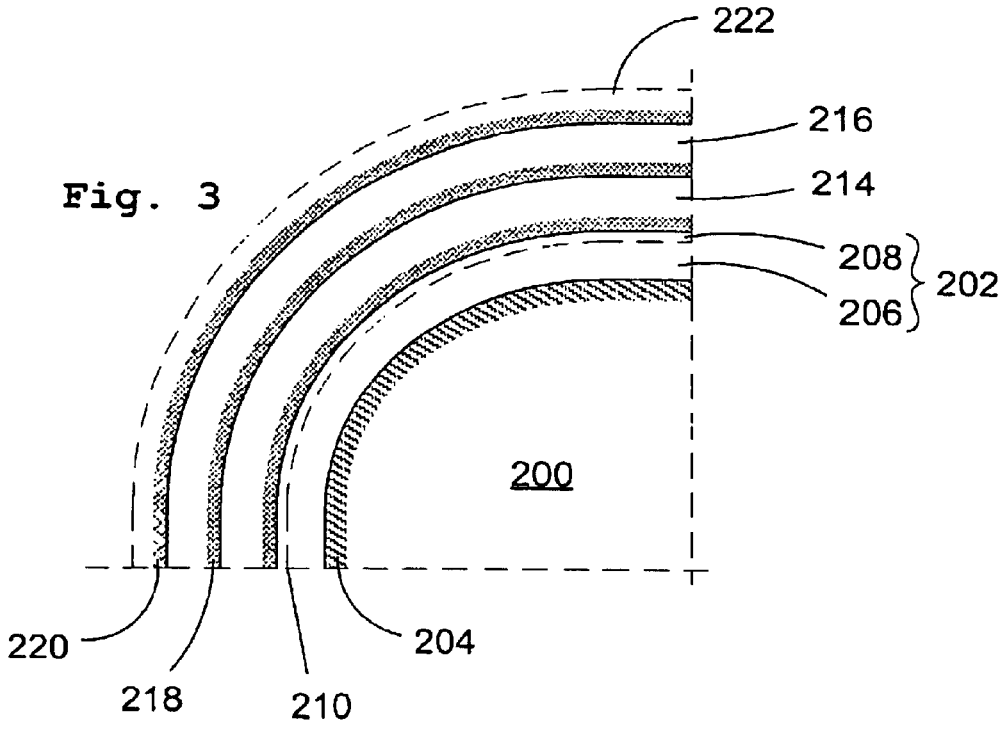
FIG. 3 is a representation of another aspect of the present invention.

The Ti(C,N) layer 202 can be made of Ti(C,N) applied by CVD (Chemical Vapor Deposition), MTCVD (Medium Temperature Chemical Vapor Deposition) processes, or combinations thereof. In a particularly preferred embodiment, the Ti(C,N) layer 202 comprises a first portion 206 adjacent the cemented carbide body 200 of columnar Ti(C,N) and a second outer portion 208 of equiaxed Ti(C,N) (see FIG. 3). In this instance, the first portion 206 comprises from about 5 to 95%, preferably from about 10 to about 80%, of the total thickness of the Ti(C,N) layer 202. In an exemplary embodiment, the first portion 206 and the second outer portion 208 are produced in accordance with and correspond in width, length and grain size with the columnar/equiaxed layer of U.S. Pat. No. 6,221,469, the entire contents of which are hereby incorporated by reference.

In another exemplary embodiment, the layer 202 of Ti(C,N) comprises a multilayer of MTCVD Ti(C,N) which may also contain at least one layer 210 of TiN and/or TiC interspersed between the multilayers of Ti(C,N).

Above the Ti(C,N) layer 202 is a bonding layer 212. The bonding layer 212 can promote adhesion and phase control of a subsequently applied alumina layer. For, example, the bonding layer 212 can include (TiAl)(CO) having a thickness of from about 0.5 to about 2 μm, preferably from about 0.5 to about 1 μm, to improve the adhesion and secure phase control of the $Al_2O_3$ which is applied thereafter.

The $Al_2O_3$ layer 214 may be a single layer of α- or κ-, or the $Al_2O_3$ layer 214 may comprise a multilayer of said $Al_2O_3$ phases. The κ-$Al_2O_3$ may be applied as a multilayer according to the teachings of U.S. Pat. No. 5,700,569, the entire contents of which are hereby incorporated by reference. The α-$Al_2O_3$ may be applied according to known techniques.

Atop the $Al_2O_3$ layer 214 is another layer 216 of from about 1 to about 15 μm, preferably from about 2 to about 6 μm, thickness of a carbide, nitride, carbonitride, or carboxynitride of Ti, Zr, Hf, or multilayers thereof. Preferably, this layer 216 is an MTCVD Ti(C,N) or Ti(C,O,N). In a particular embodiment, this layer 216 may also comprise a laminated multilayer having from about 4 to about 150 layers of Ti(C,N), each having a thickness of from about 0.05 to about 1 μm.

A bonding layer 218 of (TiAl)(CO) having a thickness of from about 0.5 to about 2 μm can be disposed between the $Al_2O_3$ layer 214 and this layer 216.

Atop the layer 216 may be provided a friction-reducing layer 220 of nanocrystalline Ti(C,N), γ-$Al_2O_3$ or κ-$Al_2O_3$. The nanocrystalline Ti(C,N) may be applied according to the teachings of U.S. Pat. No. 6,472,060, the entire contents of which are hereby incorporated by reference. This friction-reducing layer 220 helps reduce the friction in cutting between the Ti(C,N) and the metal surface to be cut. The thickness of this friction-reducing layer 220 is from about 1 to about 5 μm, preferably from about 2 to about 4 μm.

If desired, a layer of TiN, which imparts in thin form a characteristically gold-colored coating, may be applied as the outermost layer 222 of the coated cemented carbide 200. This optional layer of TiN has a thickness of from 0.5 to 2 μm, preferably from about 0.1 to about 1 μm.

Figure 4:
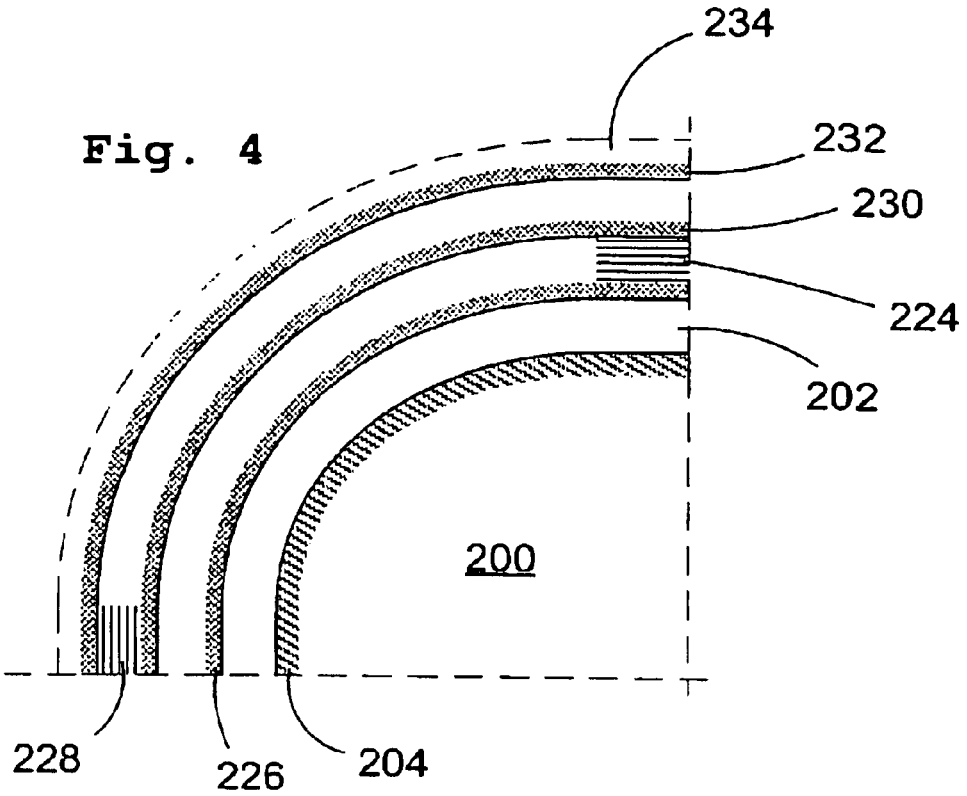
FIG. 4 is a representation of another aspect of the present invention.

In FIG. 4 there is shown a exemplary embodiment of the present invention in which the cemented carbide body 200 is coated first with the Ti(C,N) layer 202 with the optional bonding layer 204 as discussed above. A laminated alumina multilayer 224 of α-$Al_2O_3$ and κ-$Al_2O_3$ is applied onto the Ti(C,N) layer 202 with a bonding layer 226 there between. The alumina multilayer 224 of α-$Al_2O_3$ and κ-$Al_2O_3$ may comprise from about 4 up to about 150 layers of each phase of the alumina with the κ-$Al_2O_3$ being deposited according to the techniques shown in U.S. Pat. No. 5,700,569 and the α-$Al_2O_3$ in accordance with conventional techniques. Each multilayer has a thickness of from about 0.05 to about 1 μm.

Atop the alumina multilayer 224 is a multilayer 228 which may comprise either multilayers of Ti(C,N) alone or layers of Ti(C,N) interspersed with one or more layers of carbide, nitride, carbonitride, or carboxynitride of Ti, Zr, Hf, or $Al_2O_3$. For example, the multilayer can include layers of Ti(C,N)—TiC, Ti(C,N)—TiN, Ti(C,N)-κ-$Al_2O_3$, Ti(C,N)-α-$Al_2O_3$, Ti(C,N)—Ti(C,O,N), Ti(C,N)—Zr(C,N), Ti(C,N)—Hf(C,N), and combinations thereof. There may be between 4 and 150 layers within this multilayer 228. Multilayer 228 has a thickness of from about 1 to about 15 μm, preferably from about 2 to about 6 μm. A bonding layer 230, which has a total thickness for from about 0.1 to about 1 μm, may be disposed between the alumina multilayer 224 and multilayer 228, e.g., between the alumina multilayer and the multilayer of Ti(C,N). Atop the multilayer 228 of Ti(C,N) is a friction-reducing layer 232 and an optional TiN layer 234. In an exemplary embodiment, the friction-reducing layer 232 and the TiN layer 234 can be as discussed above in regard to FIG. 2 with respect to friction-reducing layer 220 and TiN layer 222.

In one preferred embodiment, which is especially applicable for applications demanding extreme toughness, the coating thickness is as follows: The first Ti(C,N) based layer is from 4 to 10, preferably 7 μm, the alumina layer is from 4 to 10, preferably about 7 μm, and the uppermost Ti(C,N) layer is from 2 to 6 μm, preferably about 4 μm. The total coating thickness is of the order of 15–25 μm.

The invention is additionally illustrated in connection with the following examples, which are to be considered as illustrative of the present invention. It should be understood, however, that the invention is not limited to the specific details of the examples.

EXAMPLE 1

Two identical multicoatings according to this invention were tested. The only difference between the coating layers was the phase composition of the $Al_2O_3$ layer. The coatings are specified in detail below:

| Coating No. 1 | Coating No. 2 |
|---|---|
| Ti(C,N), 7 μm (thickness) | Ti(C,N), 7 μm (thickness) |
| κ-$Al_2O_3$, 7 μm (thickness) | α-$Al_2O_3$, 7 μm (thickness) |
| Ti(C,N), 4 μm (thickness) | Ti(C,N), 4 μm (thickness) |

The coatings were compared in interrupted turning coolant under the following conditions:

Cutting Speed, Vc=300 m/minute

Feed, f=0.4 mm/v

Work piece material: SS1672

Operation: intermittent turning with coolant

Figure 5:
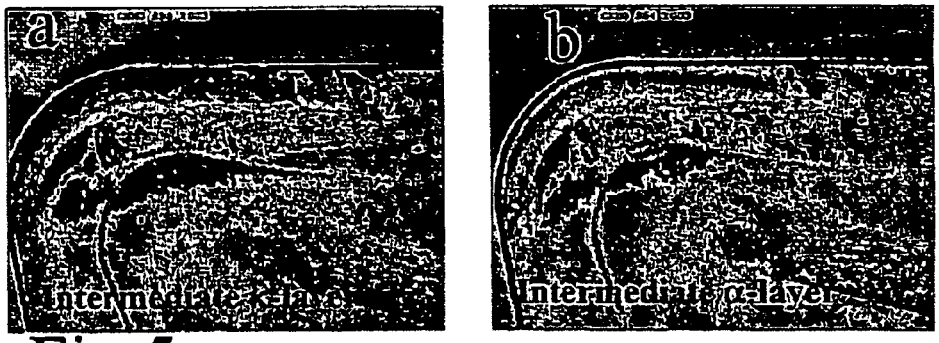
FIG. 5 shows the chipping results from inserts made according to the present invention.

FIG. 5(*a*) shows Coating No. 1 and FIG. 5(*b*) show Coating No. 2 from Example 1. As is clear from FIGS. 5(*a*) and (*b*), the coating with α-$Al_2O_3$ exhibited much less chipping.

EXAMPLE 2

The same coatings were tested in cast iron under the following conditions:

Cutting speed, Vc=400 m/minute

Depth of cut, ap=2.5 mm

Feed, f=0.4 mm/v

Work piece material: SS0130, cast iron

Figure 6:
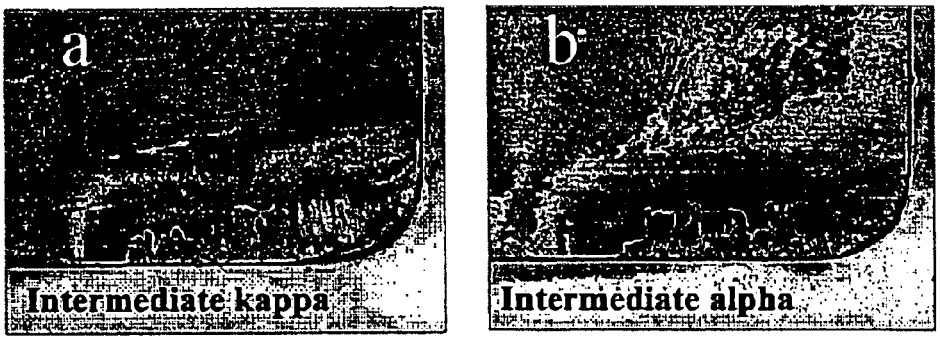
FIG. 6 shows the chipping results from inserts made according to the present invention.

FIG. 6 shows the cutting edges for Coating No. 1 (FIG. 6(*a*)) and Coating No. 2 (FIG. 6(*b*)) after 2 minutes of turning under the conditions specified in Example 2. In the presence of a relatively thick carbonitride layer atop the $Al_2O_3$ layer, the differences between the phases became very clear, with Coating No. 2, e.g., the $\alpha$-$Al_2O_3$ coating, clearly outperformed Coating No. 1, e.g., the $\kappa$-$Al_2O_3$ coating.

EXAMPLE 3

Coatings No. 1 and Coating No. 2 were tested at lower cutting speed under the following conditions:

Cutting speed, Vc=250 m/minute

Depth of cut, ap=2.5 mm

Feed, f=0.4 mm/v

Work piece material: SS0130, cast iron

Figure 7:
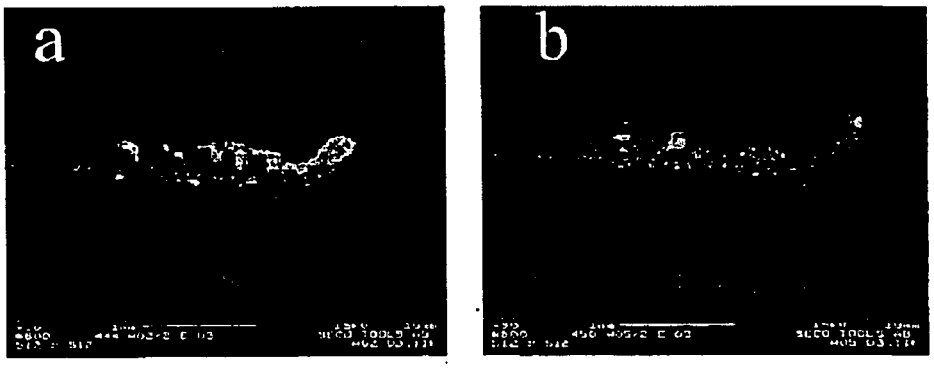
FIG. 7 shows the chipping results from inserts made according to the present invention.

FIG. 7(*a*) and FIG. 7(*b*) show edge shipping results for Coatings No. 1 and Coating No. 2, respectively. From FIGS. 7(*a*) and 7(*b*), it appears that Coating No. 2 exhibits much less edge chipping at lower cutting speeds than Coating No. 1.

EXAMPLE 4

The coatings from Example 1 were tested under the same conditions, but without coolant. The edge strength of the coating was expressed in terms of chipped edge line as percent of the edge line in contact with the workpiece material. The results of this test are shown in Table 1.

TABLE 1

Edge Strength of Coating

| Coating | Edge Chipping (%) | Lifetime (minutes) |
|---|---|---|
| Coating No. 1: Ti(C,N)- $\kappa$-$Al_2O_3$-Ti(C,N) | 26 | 12 |
| Coating No. 2: Ti(C,N)- $\alpha$-$Al_2O_{3\text{-}Ti(C,N)}$ | 8 | 15 |

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A method of machining a cast iron workpiece, the method comprising:

providing a coated cemented carbide body insert, the coated cemented carbide body insert including a cemented carbide body, a first layer adjacent the cemented carbide body, the first layer including Ti(C, N) and having a thickness of from about 3 to about 20 $\mu$m, an alumina layer adjacent said first layer, the alumina layer including $\alpha$-$Al_2O_3$ and having a thickness of from about 1 to about 15 $\mu$m, a further layer adjacent the alumina layer, the further layer including a carbide, carbonitride or carboxynitride of one or more of Ti, Zr and Hf, the further layer having a thickness of from about 1 to 15 $\mu$m, and a friction-reducing layer adjacent to the further layer, the friction-reducing layer including one or more of $\gamma$-$Al_2O_3$ and $\kappa$-$Al_2O_3$, wherein the friction-reducing layer has a thickness of from about 1 to about 5 $\mu$m;

contacting the coated cemented carbide body insert to the cast iron workpiece; and removing a portion of the cast iron workpiece in a turning operation.

2. The method of claim 1, wherein the alumina layer consists essentially of $\alpha$-$Al_2O_3$.

3. A method of machining a steel workpiece, the method comprising:

providing a coated cemented carbide body insert, the coated cemented carbide body insert including a cemented carbide body, a first layer adjacent the cemented carbide body, the first layer including Ti(C, N) and having a thickness of from about 3 to about 20 $\mu$m, an alumina layer adjacent said first layer, the alumina layer including $\alpha$-$Al_2O_3$ and having a thickness of from about 1 to about 15 $\mu$m, a further layer adjacent the alumina layer, the further layer including a carbide, carbonitride or carboxynitride of one or more of Ti, Zr and Hf, the further layer having a thickness of from about 1 to 15 $\mu$m, and a friction-reducing layer adjacent to the further layer, the friction-reducing layer including one or more $\gamma$-$Al_2O_3$ and $\kappa$-$Al_2O_3$, wherein the friction-reducing layer has a thickness of from about 1 to about 5 $\mu$m;

contacting the coated cemented carbide body insert to the steel workpiece; and removing a portion of the steel workpiece in a turning operation.

4. The method of claim 3, wherein the alumina layer consists essentially of $\alpha$-$Al_2O_3$.

5. A method of machining a steel workpiece, the method comprising:

providing a coated cemented carbide body insert, the coated cemented carbide body insert including a cemented carbide body, a first layer adjacent the cemented carbide body, the first layer including Ti(C, N) and having a thickness of from about 3 to about 20 $\mu$m, an alumina layer adjacent said first layer, the alumina layer including $\kappa$-$Al_2O_3$ and having a thickness of from about 1 to about 15 $\mu$m, a further layer adjacent the alumina layer, the further layer including a carbide, carbonitride or carboxynitride of one or more of Ti, Zr and Hf, the further layer having a thickness of from about 1 to 15 $\mu$m, and a friction-reducing layer adjacent to the further layer, the friction-reducing layer including one or more of $\gamma$-$Al_2O_3$ and $\kappa$-$Al_2O_3$, wherein the friction-reducing layer has a thickness of from about 1 to about 5 $\mu$m;

contacting the coated cemented carbide body insert to the steel workpiece; and removing a portion of the steel workpiece in a turning operation.

6. The method of claim 5, wherein the alumina layer consists essentially of $\kappa$-$Al_2O_3$.

7. A method of machining a steel workpiece, the method comprising:

providing a coated cemented carbide body insert, the coated cemented carbide body insert including a cemented carbide body, a first layer adjacent the cemented carbide body, the first layer including Ti(C, N) and having a thickness of from about 3 to about 20 $\mu$m, an alumina layer adjacent said first layer, the alumina layer including a multilayer of $\alpha$-$Al_2O_3$ and $\kappa$-$Al_2O_3$, the multilayer of from about 4 to about 150 layers and having a thickness of from about 1 to about 15 $\mu$m, a further layer adjacent the alumina layer, the further layer including a carbide, carbonitride or carboxynitride of one or more of Ti, Zr and Hf, the further layer having a thickness of from about 1 to 15 $\mu$m, and a friction-reducing layer adjacent to the further layer, the friction-reducing layer including one or more of $\gamma$-$Al_2O_3$ and $\kappa$-$Al_2O_3$, wherein the friction-reducing layer has a thickness of from about 1 to about 5 $\mu$m;

contacting the coated cemented carbide body insert to the steel workpiece; and removing a portion of the steel workpiece in a turning operation.

* * * * *